US010717953B2

(12) United States Patent
Piorkowski et al.

(10) Patent No.: US 10,717,953 B2
(45) Date of Patent: Jul. 21, 2020

(54) DETERGENT SINGLE DOSE PACKS AND METHODS OF PRODUCING THE SAME

(71) Applicant: Henkel IP & Holding GmbH, Duesseldorf (DE)

(72) Inventors: Daniel Thomas Piorkowski, Fairfield, CT (US); Casey Elphege Camire, Shelton, CT (US); David S. Stott, II, Madison, CT (US)

(73) Assignee: Henkel IP & Holding GmbH (DE)

( * ) Notice: Subject to any disclaimer, the term of this patent is extended or adjusted under 35 U.S.C. 154(b) by 107 days.

(21) Appl. No.: 15/909,292

(22) Filed: Mar. 1, 2018

(65) Prior Publication Data

US 2019/0270952 A1 Sep. 5, 2019

(51) Int. Cl.

| | |
|---|---|
| ***C11D 17/04*** | (2006.01) |
| ***C11D 1/02*** | (2006.01) |
| ***C11D 1/66*** | (2006.01) |
| ***C11D 1/94*** | (2006.01) |
| ***C11D 3/20*** | (2006.01) |
| ***C11D 3/37*** | (2006.01) |
| ***B65D 65/46*** | (2006.01) |
| ***C11D 1/38*** | (2006.01) |
| ***C11D 3/386*** | (2006.01) |
| ***C11D 11/00*** | (2006.01) |

(52) U.S. Cl.

CPC ..... *C11D 17/043* (2013.01); *C11D 1/02* (2013.01); *C11D 1/38* (2013.01); *C11D 1/66* (2013.01); *C11D 3/2065* (2013.01); *C11D 3/3707* (2013.01); *C11D 3/386* (2013.01); *C11D 11/0017* (2013.01); *C11D 11/0023* (2013.01)

(58) Field of Classification Search

None

See application file for complete search history.

(56) References Cited

U.S. PATENT DOCUMENTS

| | | | | |
|---|---|---|---|---|
| 6,037,319 | A | 3/2000 | Dickler et al. | |
| 6,228,825 | B1 * | 5/2001 | Gorlin | C11D 3/06 510/221 |
| 7,259,134 | B2 | 8/2007 | Beckholt et al. | |
| 2002/0137648 | A1 * | 9/2002 | Sharma | A47L 15/44 510/218 |
| 2003/0114332 | A1 | 6/2003 | Ramcharan et al. | |
| 2005/0101505 | A1 | 5/2005 | Wood | |
| 2006/0049077 | A1 * | 3/2006 | Fregonese | C11D 3/3945 206/524.7 |
| 2008/0293605 | A1 * | 11/2008 | Gibis | C11D 1/72 510/221 |
| 2011/0112005 | A1 | 5/2011 | Brooker et al. | |
| 2012/0135910 | A1 | 5/2012 | Gross et al. | |
| 2012/0175797 | A1 | 7/2012 | Labeque et al. | |
| 2014/0274859 | A1 | 9/2014 | Adamy | |
| 2018/0127692 | A1 * | 5/2018 | Coope-Epstein | C11D 1/72 |

FOREIGN PATENT DOCUMENTS

DE 102014202225 A1 8/2015

OTHER PUBLICATIONS

Extended European Search Report EP 19158436 Completed: Jul. 18, 2019 dated Aug. 8, 2019 5 pages.

* cited by examiner

*Primary Examiner* — Lorna M Douyon

(74) *Attorney, Agent, or Firm* — Bojuan Deng

(57) ABSTRACT

A single dose pack and methods for producing and using the same are provided. In one embodiment, a single dose pack includes a container, wherein the container comprises a water-soluble film, and a wash composition encapsulated within the container. The wash composition includes a detergent surfactant, water present in an amount of from about 8 to about 40 weight percent, based on the total weight of the wash composition, and a polyethylene glycol (PEG) blend. The PEG blend includes at least one relatively higher molecular weight (MW) PEG having an average MW of about 1500 Daltons or greater in combination with at least one relatively lower MW PEG having an average MW of about 400 Daltons or less and/or at least one mid-MW PEG having an average MW of between about 400 and about 1500 Daltons.

20 Claims, No Drawings

DETERGENT SINGLE DOSE PACKS AND METHODS OF PRODUCING THE SAME

TECHNICAL FIELD

The technical field relates to detergent packaged in single dose packs and methods of producing the same, and more particularly relates to single dose packs with solvent loadings that are higher than typical and methods of producing the same.

BACKGROUND

Detergent packaged in single dose packs is available for a variety of washing activities, such as clothes laundering and dish washing. The single dose pack provides a premeasured quantity of detergent that is easy to carry and convenient to use. The single dose pack minimizes overdosage of detergent and has proven popular with consumers.

Many single dose packs include a wash composition that is encapsulated within a film, where the wash composition includes detergent, solvents, and other components useful for cleaning. Consumers are accustomed to a standard size of single dose pack, so changes in the wash composition that reduce the total volume may be compensated for by increasing the solvent loading to maintain a more constant single dose pack size. However, increases in the solvent loading typically result in degradation of the film over time. The film is typically soluble in water, so increases in the water loading have an increased propensity to degrade the film. Water is one solvent often utilized in single dose packs. In some cases, a single dose pack can fail and produce an unpleasant mess, such as when the single dose pack may become "sticky," deformed, or otherwise less attractive to a consumer. In some cases, the film can rupture before use. A ruptured single dose pack can contaminate other single dose packs stored in proximity, so an entire container of single dose packs becomes unpleasant to use.

Typically, liquid laundry detergents with high water contents are not encapsulated in water-soluble films to avoid film degradation during storage. The advantages of liquid laundry detergents over granules, pastes, and gels include aesthetic appearance and quicker delivery to and dispersibility of the detergent in a wash liquor, especially in a cool or cold water washing process.

Including additional, organic, solvents in the wash composition also increases the overall size, rigidity, and stability of the single dose pack. The increased size and rigidity results in a single dose pack that is more aesthetically pleasing to handle. Furthermore, increased size and rigidity produces a single dose pack that looks more "full" to consumers, where the single dose pack does not deform or collapse as much during storage. However, some organic solvents may be difficult to process during the manufacture of the wash composition, requiring more energy to store and longer times to dissolve when the unit dose packs are in use. In particular, organic solvents that are solid at room temperature are often handled and transported as hot melts, thus requiring an energy input. Conversely, if these organic solvents are added to the wash composition initially in solid form, they take a longer time to dissolve as compared to liquid solvent additions.

Accordingly, it is desirable to provide a single dose pack with increased solvent loading where the film remains structurally sound for extended periods, and methods of producing such single dose packs. Additionally, it is desirable to provide such single dose packs and methods that reduce the energy and time required for their manufacture. Furthermore, other desirable features and characteristics will become apparent from the subsequent detailed description and the appended claims, and the foregoing technical field and background.

BRIEF SUMMARY

It has been discovered by the inventors that the inclusion of polyethylene glycol (PEG) in the wash composition allows for the incorporation of relatively higher solvent levels than would otherwise be possible while still avoiding film degradation. It has been further discovered that, on a relative basis, the higher molecular weight (MW) of PEG employed, the greater amount of solvent that can be safely included in the wash composition. Higher MW PEGs, however, are more difficult to process during the manufacture of the wash composition, requiring more energy to store and longer times to dissolve.

It has been unexpected discovered that a blend of PEGs containing a high MW PEG and a low/mid MW PEG begins behaving in a manner similar to the highest MW PEG in the blend alone. This is of particular interest in unit dose systems because they can retain high water content without premature rupture of the unit dose packs. Further, carefully designed PEG blends may have lower melting points, reducing the energy needed to store them, and may dissolve more quickly during liquid processing, reducing cycle time. In addition, PEG blends may enhance the stability of the finished liquid by increasing cloud point and reducing the chance of precipitation.

Single dose packs and methods for producing and using the same are provided. In accordance with one embodiment, a single dose pack includes a container, wherein the container comprises a water-soluble film, and a wash composition encapsulated within the container. The wash composition includes a detergent surfactant, water present in an amount of from about 8 to about 40 weight percent, based on the total weight of the wash composition, and a polyethylene glycol (PEG) blend. The PEG blend includes at least one relatively higher molecular weight (MW) PEG having an average MW of about 1500 Daltons or greater in combination with at least one relatively lower MW PEG having an average MW of about 400 Daltons or less and/or at least one mid-MW PEG having an average MW of between about 400 and about 1500 Daltons. The PEG blend is present in an amount of from about 15 to about 50 weight percent, based on the total weight of the wash composition.

In accordance with another embodiment, a method of producing a single dose pack includes forming a wash composition and encapsulating the wash composition within a container to form the single dose pack. The container includes a water-soluble film. The wash composition includes a detergent surfactant, water present in an amount of from about 8 to about 40 weight percent, based on the total weight of the wash composition, and a polyethylene glycol (PEG) blend present in an amount of from about 15 to about 50 weight percent, based on the total weight of the wash composition. The PEG blend includes at least one relatively higher molecular weight (MW) PEG having an average MW of about 1500 Daltons or greater in combination with at least one relatively lower MW PEG having an average MW of about 400 Daltons or less and/or at least one mid-MW PEG having an average MW of between about 400 and about 1500 Daltons.

In accordance with yet another embodiment, a single dose pack for use in a laundry washing machine or a dishwashing machine includes a container, wherein the container comprises a water-soluble film, and a wash composition encapsulated within the container. The wash composition includes a detergent surfactant. The detergent surfactant includes an ionic detergent surfactant in an amount from about 5 to about 55 weight percent and/or a non-ionic detergent surfactant in an amount from about 5 to about 50 weight percent, based on the total weight of the wash composition. The wash composition further includes an enzyme in an amount from about 0.001 to about 1 weight percent, based on the total weight of the wash composition. The wash composition further includes water present in an amount of from about 10 to about 30 weight percent, based on the total weight of the wash composition. Still further, the wash composition includes a polyethylene glycol (PEG) blend including at least one relatively higher molecular weight (MW) PEG having an average MW of about 1500 Daltons or greater in combination with at least one relatively lower MW PEG having an average MW of about 400 Daltons or less and/or at least one mid-MW PEG having an average MW of between about 400 and about 1500 Daltons. The PEG blend is present in an amount of from about 15 to about 40 weight percent, based on the total weight of the wash composition.

DETAILED DESCRIPTION

The following detailed description is merely exemplary in nature and is not intended to limit the single dose pack, or the method for producing or using the same. Furthermore, there is no intention to be bound by any theory presented in the preceding background or the following detailed description.

The term "about" as used in connection with a numerical value throughout the specification and the claims denotes an interval of accuracy, familiar and acceptable to a person skilled in the art. In general, such interval of accuracy is ±10%. Thus, "about ten" means 9 to 11. All numbers in this description indicating amounts, ratios of materials, physical properties of materials, and/or use are to be understood as modified by the word "about," except as otherwise explicitly indicated.

The term PEG stands for polyethylene glycol. As conventionally used in the art, the use of PEG alone, not followed by a number, refers to PEG with all possible molecular weight (MW). The use of PEG with a specific number, for example, "PEG 400", indicates that that PEG having a weight average molecular weight of about 400, for example having MW ranging from about 380 to about 420.

The term "relatively higher molecular weight (MW) PEG" refers to PEG having a weight average MW of about 1500 Daltons or greater. Suitable relatively higher MW PEGS may include those having a weight average Mw of about 1500, about 1600, about 1700, about 1800, about 1900, about 2000, about 2100, about 2200, about 2300, about 2400, about 2500, or about 2600, about 2700, about 2800, about 2900, about 3000, about 3100, about 3200, about 3300, about 3400, about 3500, about 3600, about 3700, about 3800, about 3900, and/or about 4000 Daltons.

The term "relatively lower MW PEG" refers to PEG having a weight average MW of about 400 Daltons or less. Suitable relatively lower MW PEGs may include those having a weight average molecular weight of PEG 200, PEG 250, PEG 300, PEG 350, and/or PEG 400 Daltons.

The term "mid-MW PEG" refers to PEG having a weight average MW of between about 400 and about 1500 Daltons. Suitable mid-MW PEGs can have a weight average molecular weight of, for example, about 450, about 500, about 600, about 700, about 800, about 900, about 1000, about 1100, about 1200, about 1300, about 1400, and/or about 1450 Daltons.

A single dose pack is formed by encapsulating a wash composition within a container, where the container includes a film. In some embodiments, the film forms one half or more of the container, where the container may also include dyes, print, or other components in some embodiments. The film is water soluble such that the film will completely dissolve when an exterior of the film is exposed to water, such as in a washing machine typically used for laundry. When the film dissolves, the container is ruptured and the contents are released. As used herein, "water soluble" means at least 2 grams of the solute (the film in one example) will dissolve in 5 liters of solvent (water in one example,) for a solubility of at least 0.4 grams per liter (g/l), at a temperature of 25 degrees Celsius (° C.) unless otherwise specified. Suitable films for packaging are completely soluble in water at temperatures of about 5° C. or greater.

The film is desirably strong, flexible, shock resistant, and non-tacky during storage at both high and low temperatures and high and low humidities. In an exemplary embodiment, the film is initially formed from polyvinyl acetate, and at least a portion of the acetate functional groups are hydrolyzed to produce alcohol groups. Therefore, the film includes polyvinyl alcohol (PVOH), and may include a higher concentration of PVOH than polyvinyl acetate. Such films are commercially available with various levels of hydrolysis, and thus various concentrations of PVOH, and in an exemplary embodiment the film initially has about 85 percent of the acetate groups hydrolyzed to alcohol groups. Some of the acetate groups may further hydrolyze in use, so the final concentration of alcohol groups may be higher than the concentration at the time of packaging. The film may have a thickness of from about 25 to about 200 microns (μm), or from about 45 to about 100 μm, or from about 75 to about 90 μm in various embodiments. The film may include alternate materials in some embodiments, such as methyl hydroxy propyl cellulose and polyethylene oxide, but the film is water soluble in all embodiments.

The single dose pack may be formed from a container having a single compartment, but the single dose pack may be formed from containers with two or more different compartments in alternate embodiments. In embodiments with a container having two or more compartments, the contents of the different compartments may or may not the same. In some embodiments, the single dose pack is formulated and configured for cleaning laundry, but other cleaning purposes are also possible. The wash composition is positioned within the container, and the container is sealed to encase and enclose the wash composition. The wash composition is typically in direct contact with the film of the container within the single dose pack. The film of the container is sealable by heat, heat and water, ultrasonic methods, or other techniques, and one or more sealing techniques may be used to enclose the wash composition within the container.

In an exemplary embodiment, the wash composition is liquid when encapsulated within the container. The liquid wash composition has a viscosity of from about 50 to about 2,500 centipoise, or from about 100 to about 500 centipoise in different embodiments, where "viscosity," as used herein, means the viscosity measured by a rotational viscometer at a temperature of 25 degrees Celsius (° C.). The liquid form facilitates rapid delivery and dispersion of the wash composition once the container ruptures, and this rapid dispersion can aid cleaning. In an exemplary embodiment, the single dose pack is sized to provide a desired quantity of wash composition for one load of laundry or one batch of dishes in a dishwasher. The single dose pack may also be sized for a fraction of a desired quantity, such as one half of a load of laundry, so a user can adjust the amount of detergent added without having to split a single dose pack. In an exemplary embodiment, the single dose pack has a weight of from about 15 to about 50 grams. In alternate embodiments, the single dose pack is from about 15 to about 40 grams, or from about 17 to about 30 grams.

A single dose pack that includes the concentrations of solvents described herein may be more likely to have favorable pack haptics, film stability, and desirable dissolution rates. A percent pack height loss is a ratio of a change in pack height (original pack height minus a final pack height after storage) to the original pack height. Single dose packs tend to lose some pack height with storage, and the percent pack height loss is a good indication of the haptics of the pack. A single dose pack with a low percent pack height loss has a more appealing appearance to a user, where a package with several single dose packs looks fuller and each single dose pack appears fresher and more appealing. The concentration of water and non-aqueous solvents as described herein has a significant effect on the percent pack height loss. As such, as noted above, it is desirable to increase the amount of water relative to prior wash compositions. The % pack height loss, as described herein, is based on a storage time of about 2 months at a storage temperature of about 24° C.

A plurality of components are combined to form a wash composition, where the wash composition is typically prepared prior to encapsulated within the container. However, in some embodiments, the components of the wash composition may be enclosed in different compartments of a multi-compartment unit dose packs and all the components are released simultaneously or consecutively upon use. As noted above, it is desirable to reduce the amount of energy and the length of time required to prepare the wash composition. The plurality of components include water, and as mentioned above the film is soluble in water. The film remains structurally sound and intact prior to use of the single dose pack, where the single dose pack is immersed in a large quantity of water in use. A "large" quantity of water is at least about 100 times the weight of the single dose pack. For example, a single dose pack having a weight of from about 5 to about 50 grams may be immersed in from about 5 to about 50 liters of water in use. As used herein, "structurally sound" means the container and the film do not rupture or leak under typical storage conditions, such as about 0.5 to about 1.5 atmospheres of pressure, temperatures of about −10 to about 35° C., and a relative humidity of about 1 to about 80% for a period of at least 1 week. Structurally sound also means the container and the film are not tacky or sticky to the touch.

Water is included in the wash composition. In some embodiments, water is present in an amount of from about 8 to about 40 weight percent, from about 10 to about 30 weight percent, from about 12 to about 27 weight percent, from about 15 to about 22 weight percent, or from about 18 to about 20 weight percent. In other embodiments, water is present in an amount of from about 8 to about 10 weight percent, from about 10 to about 15 weight percent, from about 15 to about 20 weight percent, from about 20 to about 25 weight percent, from about 25 to about 30, from about 30 to about 35 weight percent, or from about 35 to about 40 weight percent. Water may be added to the wash composition directly or as a component of other ingredients, or directly and as a component of other ingredients.

The solubility of the film in water should be moderated to keep the film structurally sound prior to use. The water in the wash composition directly contacts the film in the single dose pack in many embodiments. However, the addition of certain other components in the wash composition can moderate the solubility of the film and thereby protect the film from dissolving in the water incorporated in the wash composition. It has been found that the inclusion of some non-aqueous solvents in the wash composition does moderate the solubility of the film. As such, adding the non-aqueous solvent to the wash composition allows for single dose packs where the wash composition includes water present in amounts of up to about 40 weight percent, based on the total weight of the wash composition, and where the film remains structurally sound during storage for a time period of from about 1 month to about 24 months or more. Structurally sound also means the film is not tacky or sticky to the touch.

As initially noted above, it has been demonstrated that PEG is a suitable non-aqueous solvent that may be incorporated into the wash composition in order to increase the amount of water possible in the wash composition, where relatively higher MW PEGs allow for relative greater amounts of water. However, as also noted above, relatively higher MW PEGs require more energy to store (prior to mixing into the wash composition in liquid form) and require longer mixing times to fully incorporate into to the wash composition. Furthermore, relatively higher MW PEGs tend to precipitate from the wash composition during storage, which may reduce its efficacy in preventing the water in the wash composition from dissolving the film.

As used in the present disclosure, PEGs having a MW average of about 400 Daltons or less (such as down to about 100 Daltons) are referred to as the relatively lower MW PEGs. PEGS having a MW average of about 1500 Daltons or more (such as up to about 10,000 Daltons, or up to about 5,000 Daltons) are referred to as the relatively higher MW PEGS. Furthermore, PEGS having MW averages that fall between these two limits (i.e., between about 400 and about 1500 Daltons) are referred to herein as mid-MW PEGs. (Number average molecular weights are used in the present disclosure.)

It had been previously assumed that a blend of different MW PEGs in a wash composition would behave as a linear combination of the constituents of the blend (e.g., a blend of 50% by weight of 200 Dalton PEG with 50% by weight of 2200 Dalton PEG would behave in the wash composition in a manner equivalent to the same amount of 1200 Dalton PEG, with regard to the amount of water able to be safely included). However, it was surprisingly discovered that a blend of a relatively higher MW PEG with a relatively lower MW PEG (and/or a mid-MW PEG) will behave in the wash composition in the same manner as the relatively higher MW PEG alone up to a particular weight percentage of the relatively lower MW PEG (and/or mid-MW PEG). The term "PEG blend" refers to all PEG present in the composition.

While each blend of a relatively higher MW PEG with a relatively lower MW PEG and/or a mid-MW PEG may be dependent on the particular MWs of the PEGs employed in the blend, the following MW-class blend ratios have been found to be suitable: For a relatively higher MW PEG blended with a relatively lower MW PEG, embodiments of the present disclosure may include from about 5 to about 30 weight percent, such as from about 5 to about 25 weight percent, for example from about 5 to about 20 weight percent, or about 10 to about 30 weight percent, or about 10 to about 25 weight percent, of the relatively lower MW PEG (balance being the relatively higher MW PEG), based on the overall weight of the PEG blend. In other embodiments, the relatively lower MW PEG is present in an amount of about 5 to about 10 weight percent, or from about 10 to about 15 weight percent, or from about 15 to about 20 weight percent, or from about 20 to about 25 weight percent, or from about 25 to about 30 weight percent (balance being the relatively higher MW PEG), based on the overall weight of the PEG blend.

For a relatively higher MW PEG blended with a mid-MW PEG, embodiments of the present disclosure may include from about 5 to about 70 weight percent, such as from about 20 to about 65 weight percent, or about 30 to about 60 weight percent, for example from about 20 to about 55 weight percent of the mid-MW PEG, or about 30 to about 55 weight percent (balance being the relatively higher MW PEG), based on the overall weight of the PEG blend. In other embodiment, the mid-MW PEG may be present from about 5 to about 15 weight percent, from about 15 to about 25 weight percent, from about 25 to about 35 weight percent, from about 35 to about 45 weight percent, from about 45 to about 55 weight percent, or from about 55 to about 70 weight percent (balance being the relatively higher MW PEG), based on the overall weight of the PEG blend.

For a blend of a relatively higher MW PEG with both a mid-MW PEG and a relatively lower MW PEG, embodiments of the present disclosure may include about 5 to about 20 weight percent, such as from about 5 to about 15 weight percent, or about 10 to about 20 weight percent of the relatively lower MW PEG and about 5 to about 40 weight percent, such as from about 10 to about 35 weight percent, or about 10 to about 30 weight percent, or about 15 to about 30 weight percent of the mid-MW PEG (balance being the relatively higher MW PEG), based on the overall weight of the PEG blend. In other embodiments, the relatively lower MW PEG may be present in about 5 to about 10 weight percent, or about 10 to about 15 weight percent, or about 15 to about 20 weight percent, and the mid-MW PEG may be present in about 5 to about 15 weight percent, or about 15 to about 25 weight percent, or about 25 to about 35 weight percent, or about 30 to about 40 weight percent (balance being the relatively higher MW PEG), based on the overall weight of the PEG blend. It should be understood that combinations of two or more PEGs that are within the same MW class may be used as long as their sum remains within the above-described ranges for the particular MW class in the blend. Increasing the relative weight percentage of the lower or mid-MW PEG beyond the above ranges may result in a decrease in the water-loading efficacy of the blend to something less than the relatively higher MW PEG alone. Thus, using these PEG blends, it becomes possible to take advantage of some of the energy and processing time benefits of utilizing lower MW PEGS, while still retaining the water loading benefits of the relatively higher MW PEGs.

The PEG blend non-aqueous solvent in accordance with any of the foregoing embodiments is included in the wash composition at amounts of from about 15 to about 50 weight percent, or from about 15 to about 45 weight percent, or from about 15 to about 40 weight percent, or from about 20 to about 50 weight percent, or from about 20 to about 40 weight percent, or from about 20 to about 30 weight percent, in various embodiments, based on the total weight of the wash composition. In other embodiments, the PEG blend non-aqueous solvent is present in an amount of from about 15 to about 20 weight percent, from about 20 to about 25 weight percent, from about 25 to about 30 weight percent, from about 30 to about 35 weight percent, from about 35 to about 40, from about 40 to about 45 weight percent, or from about 45 to about 50 weight percent.

Besides the PEG blends as described above, the wash composition may optionally include other non-aqueous solvents. For example, other non-aqueous solvents that may be included in the wash composition are glycerol, propylene glycol, ethylene glycol, ethanol, and a 4C+ compounds. The term "4C+ compound" refers to one or more of: polypropylene glycol; polyethylene glycol esters such as polyethylene glycol stearate, propylene glycol laurate, and/or propylene glycol palmitate; methyl ester ethoxylate; diethylene glycol; dipropylene glycol; sorbitol; tetramethylene glycol; butylene glycol; pentanediol; hexylene glycol; heptylene glycol; octylene glycol; 2-methyl, 1,3 propanediol; xylitol; mannitol; erythritol; dulcitol; inositol; adonitol; triethylene glycol; polypropylene glycol; glycol ethers, such as ethylene glycol monobutyl ether, diethylene glycol monobutyl ether, triethylene glycol monobutyl ether, ethylene glycol monopropyl ether, diethylene glycol monoethyl ether, triethylene glycol monoethyl ether, diethylene glycol monomethyl ether, and triethylene glycol monomethyl ether; tris (2-hydroxyethyl)methyl ammonium methylsulfate; ethylene oxide/propylene oxide copolymers with a number average molecular weight of 3,500 Daltons or less; and ethoxylated fatty acids.

The wash composition may include other components as well. For example, the wash composition may include an ionic detergent surfactant, where the ionic detergent surfactant is formulated for laundry in an exemplary embodiment. The ionic detergent surfactant may include one or more surfactants, including cationic and/or anionic surfactants, in various embodiments. The ionic detergent surfactant may be present in the wash composition at a concentration of from about 5 to about 55 weight percent in one embodiment, but the ionic detergent surfactant may be present in the wash composition at a concentration of about 10 to about 30 weight percent or from about 20 to about 25 weight percent in alternate embodiments, where weight percentages are based on a total weight of the wash composition.

Suitable ionic detergent surfactants that are anionic include soaps which contain sulfate or sulfonate groups, including those with alkali metal ions as cations. Usable soaps include alkali metal salts of saturated or unsaturated fatty acids with 12 to 18 carbon (C) atoms. Such fatty acids may also be used in incompletely neutralized form. Usable ionic detergent surfactants of the sulfate type include the salts of sulfuric acid semi esters of fatty alcohols with 12 to 18 C atoms, and/or alcohol ethoxysulfates. Usable ionic detergent surfactants of the sulfonate type include alkane sulfonates with 12 to 18 C atoms and olefin sulfonates with 12 to 18 C atoms, such as those that arise from the reaction of corresponding mono-olefins with sulfur trioxide, alpha-sulfofatty acid esters such as those that arise from the sulfonation of fatty acid methyl or ethyl esters, and lauryl ether sulfates.

Suitable ionic detergent surfactants that are cationic may include textile-softening substances of the general formula X, XI, or XII as illustrated below:

(X)

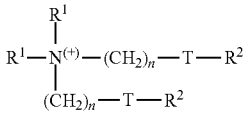

-continued (XI)

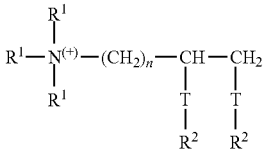

(XII)

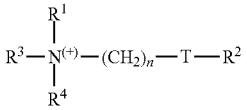

in which each $R^1$ group is mutually independently selected from among $C_{1-6}$ alkyl, alkenyl or hydroxyalkyl groups; each $R^2$ group is mutually independently selected from among $C_{8-28}$ alkyl or alkenyl groups; $R^3$=$R^1$ or $(CH_2)_n$-T-$R^2$; $R^4$=$R^1$ or $R^2$ or $(CH_2)_n$-T-$R^2$; T=—$CH_2$—, —O—CO—, or —CO—O—, and n is an integer from 0 to 5. The ionic detergent surfactants that are cationic may include conventional anions of a nature and number required for charge balancing. Alternatively, the ionic detergent surfactant may include anionic detergent surfactants that may function to balance the charges with the cationic detergent surfactants. In some embodiments, ionic detergent surfactants that are cations may include hydroxyalkyltrialkylammonium compounds, such as $C_{12-18}$ alkyl(hydroxyethyl) dimethyl ammonium compounds, and may include the halides thereof, such as chlorides or other halides. The ionic detergent surfactants that are cations may be especially useful for compositions intended for treating textiles.

In some embodiments, the anionic surfactant is a polyethoxylated alcohol sulfate, such as those sold under the trade name CALFOAM® 303 (Pilot Chemical Company, California). Such materials, also known as alkyl ether sulfates (AES) or alkyl polyethoxylate sulfates, are those which correspond to the following formula (XIII):

$$R'—O—(C2H4O)n\text{-}SO3M' \quad (XIII)$$

wherein R' is a C8-C20 alkyl group, n is from 1 to 20, and M' is a salt-forming cation, preferably, R' is C10-C18 alkyl, n is from 1 to 15, and M' is sodium, potassium, ammonium, alkylammonium, or alkanolammonium. In another embodiment, R' is a C12-C16 alkyl, n is from 1 to 6 and M' is sodium. In another embodiment, the alkyl ether sulfate is sodium lauryl ether sulphate (SLES).

In some embodiments, the anionic surfactant can be linear alkylbenzene sulfonic acid (LAS) or a salt thereof, alkyl ethoxylated sulphate, alkyl propoxy sulphate, alkyl sulphate, or a mixture thereof. Linear alkylbenzenesulfonate (LAS) is a water soluble salt of a linear alkyl benzene sulfonate having between 8 and 22 carbon atoms of the linear alkyl group. The salt can be an alkali metal salt, or an ammonium, alkylammonium, or alkanolammonium salt. In one embodiment, the LAS comprises an alkali metal salt of $C_{10}$-$C_{16}$ alkyl benzene sulfonic acids, such as $C_{11}$-$C_{14}$ alkyl benzene sulfonic acids.

However, in other embodiments, the liquid compositions are substantially free of LAS. In other embodiments, the liquid compositions are substantially free of a sulfate surfactant.

Nonionic detergent surfactants may optionally be present in the wash composition at a concentration of from about 0 to about 60 weight percent, or from about 5 to about 50 weight percent, or from about 10 to about 30 weight percent, or from about 20 to about 40 weight percent in various embodiments. Suitable nonionic detergent surfactants include alkyl glycosides and ethoxylation and/or propoxylation products of alkyl glycosides or linear or branched alcohols in each case having 12 to 18 C atoms in the alkyl moiety and 3 to 20, or 4 to 10, alkyl ether groups. Corresponding ethoxylation and/or propoxylation products of N-alkylamines, vicinal diols, fatty acid esters and fatty acid amides, which correspond to the alkyl moiety in the stated long-chain alcohol derivatives, may furthermore be used. Alkylphenols having 5 to 12 C atoms may also be used in the alkyl moiety of the above described long-chain alcohol derivatives.

Examples of nonionic surfactants suitable for the present invention include, but are not limited to, polyalkoxylated alkanolamides, polyoxyalkylene alkyl ethers, polyoxyalkylene alkylphenyl ethers, polyoxyalkylene sorbitan fatty acid esters, polyoxyalkylene sorbitol fatty acid esters, polyoxyethylene polyoxypropylene alkyl ethers, polyoxyalkylene castor oils, polyoxyalkylene alkylamines, glycerol fatty acid esters, alkylglucosamides, alkylglucosides, alkylamine oxides, amine oxide surfactants, alkoxylated fatty alcohols, or a mixture thereof. In some embodiments, the nonionic surfactant is alcohol ethoxylate (AE), alcohol propoxylate, or a mixture thereof. In other embodiments, the nonionic surfactant is AE.

The AE may be primary and secondary alcohol ethoxylates, especially the $C_8$-$C_{20}$ aliphatic alcohols ethoxylated with an average of from 1 to 20 moles of ethylene oxide per mole of alcohol, and more especially the $C_{10}$-$C_{15}$ primary and secondary aliphatic alcohols ethoxylated with an average of from 1 to 10 moles, or from 3 to 8 moles of ethylene oxide per mole of alcohol.

Exemplary AEs are the condensation products of aliphatic $C_8$-$C_{20}$, preferably $C_8$-$C_{16}$, primary or secondary, linear or branched chain alcohols with ethylene oxide. In some embodiments, the alcohol ethoxylates contain 1 to 20, or 3 to 8 ethylene oxide groups, and may optionally be end-capped by a hydroxylated alkyl group.

In one embodiment, the AE has Formula (XIV):

$$R_2—(—O—C_2H_4—)_m—OH \quad (XIV)$$

wherein $R_2$ is a hydrocarbyl group having 8 to 16 carbon atoms, 8 to 14 carbon atoms, 8 to 12 carbon atoms, or 8 to 10 carbon atoms; and m is from 1 to 20, or 3 to 8.

The hydrocarbyl group may be linear or branched, and saturated or unsaturated. In some embodiments, $R_2$ is a linear or branched $C_8$-$C_{16}$ alkyl or a linear group or branched $C_8$-$C_{16}$ alkenyl group. Preferably, $R_2$ is a linear or branched $C_8$-$C_{16}$ alkyl, $C_8$-$C_{14}$ alkyl, or $C_8$-$C_{10}$ alkyl group. In case (e.g., commercially available materials) where materials contain a range of carbon chain lengths, these carbon numbers represent an average. The alcohol may be derived from natural or synthetic feedstock. In one embodiment, the alcohol feedstock is coconut, containing predominantly $C_{12}$-$C_{14}$ alcohol, and oxo $C_{12}$-$C_{15}$ alcohols.

One suitable AE is Tomadol® 25-7 (available from Air Product). Other suitable AEs include Genapol® C200 (available from Clariant), which is a coco alcohol having an average degree of ethoxylation of 20.

Several other components may optionally be added to and included in the wash composition, including but not limited to enzymes, peroxy compounds, bleach activators, anti-redeposition agents, neutralizers, optical brighteners, foam inhibitors, chelators, buttering agents, dye transfer inhibitors, soil release agents, water softeners, and other components. A partial, non-exclusive list of additional components (not illustrated) that may be added to and included in the wash composition include electrolytes, pH regulators, graying inhibitors, anti-crease components, bleach agents, colorants, scents, processing aids, antimicrobial agents, and preservatives.

Possible enzymes that may be in the wash composition contemplated herein include one or more of a protease, lipase, cutinase, amylase, carbohydrase, cellulase, pectinase, mannanase, arabinase, galactanase, xylanase, oxidase, (e.g., a laccase), and/or peroxidase, but others are also possible. In general, the properties of the selected enzyme(s) should be compatible with the selected wash composition, (i.e., pH-optimum, compatibility with other enzymatic and non-enzymatic ingredients, etc.). The detergent enzyme(s) may be included in the wash composition by adding separate additives containing one or more enzymes, or by adding a combined additive comprising all the enzymes that are added to the wash composition. The enzyme(s) should be present in the wash composition in effective amounts, such as from about 0 weight percent to about 5 weight percent of enzyme, or from about 0.001 to about 1 weight percent, or from about 0.2 to about 2 weight percent, or from about 0.5 to about 1 weight percent, based on the total weight of the wash composition, in various embodiments.

As alluded to above, a peroxy compound may optionally be present in the wash composition. Exemplary peroxy compounds include organic peracids or peracidic salts of organic acids, such as phthalimidopercaproic acid, perbenzoic acid or salts of diperdodecanedioic acid, hydrogen peroxide and inorganic salts that release hydrogen peroxide under the washing conditions, such as perborate, percarbonate and/or persilicate. Hydrogen peroxide may also be produced with the assistance of an enzymatic system, i.e. an oxidase and its substrate. Other possible peroxy compounds include alkali metal percarbonates, alkali metal perborate monohydrates, alkali metal perborate tetrahydrates or hydrogen peroxide. Peroxy compounds may be present in the wash composition at an amount of from about 0 to about 50 weight percent, or an amount of from about 3 to about 30 weight percent, or an amount of from about 3 to about 10 weight percent, based on the total weight of the wash composition, in various embodiments.

Bleach activators may optionally be added and included in the wash composition. Conventional bleach activators that form peroxycarboxylic acid or peroxyimidic acids under perhydrolysis conditions and/or conventional bleach-activating transition metal complexes may be used. The bleach activator optionally present may include, but is not limited to, one or more of: N- or O-acyl compounds, for example polyacylated alkylenediamines, such as tetraacetylethylenediamine; acylated glycolurils, such as tetraacetylglycoluril; N-acylated hydantoins; hydrazides; triazoles; urazoles; diketopiperazines; sulfurylamides and cyanurates; carboxylic anhydrides, such as phthalic anhydride; carboxylic acid esters, such as sodium isononanoylphenolsulfonate; acylated sugar derivatives, such as pentaacetyl glucose; and cationic nitrile derivatives such as trimethylammonium acetonitrile salts.

To avoid interaction with peroxy compounds during storage, the bleach activators may be coated with shell substances or granulated prior to addition to the wash composition, in a known manner. As such, the bleach activator and/or other components may be present in a liquid wash composition as a free or floating particulate. Exemplary embodiments of the coating or shell substance include tetraacetylethylenediamine granulated with the assistance of carboxymethylcellulose and having an average grain size of 0.01 mm to 0.8 mm, granulated 1,5-diacetyl-2,4-dioxohexahydro-1,3,5-triazine, and/or trialkylammonium acetonitrile formulated in particulate form. In alternative embodiments, the bleach activators may be enclosed in a compartment, separate from the compartment that contains peroxy compounds and/or other compounds of the wash composition. In various embodiments, the bleach activators may be present in the wash composition in quantities of from about 0 to about 8 weight percent, or from about 0 to about 6 weight percent, or from about 0 to about 4 weight percent, in each case relative to the total weight of the wash composition.

One or more anti-redeposition agents may also be optionally included in the wash composition. Anti-redeposition agents include polymers with a soil detachment capacity, which are also known as "soil repellents" due to their ability to provide a soil-repelling finish on the treated surface, such as a fiber. Anti-redeposition agents include polymers with a soil detachment capacity. One example in regard to polyesters includes copolyesters prepared from dicarboxylic acids, such as adipic acid, phthalic acid or terephthalic acid. In an exemplary embodiment, an anti-redeposition agents includes polyesters with a soil detachment capacity that include those compounds which, in formal terms, are obtainable by esterifying two monomer moieties, the first monomer being a dicarboxylic acid HOOC-Ph-COOH and the second monomer a diol HO—(CHR$^{11}$—)aOH, which may also be present as a polymeric diol H—(O—(CHR$^{11}$—)$_a$)$_b$OH. Ph here means an ortho-, meta- or para-phenylene residue that may bear 1 to 4 substituents selected from alkyl residues with 1 to 22 C atoms, sulfonic acid groups, carboxyl groups and mixtures thereof. R$^{11}$ means hydrogen or an alkyl residue with 1 to 22 C atoms and mixtures thereof "a" means a number from 2 to 6 and "b" means a number from 1 to 300. The polyesters obtainable therefrom may contain not only monomer diol units —O—(CHR$^{11}$—)$_a$O— but also polymer diol units —(O—(CHR$^{11}$—)$_a$)$_b$O—. The molar ratio of monomer diol units to polymer diol units may amount to from about 100:1 to about 1:100, or from about 10:1 to about 1:10 in another embodiment. In the polymer diol units, the degree of polymerization "b" may be in the range of from about 4 to about 200, or from about 12 to about 140 in an alternate embodiment. The average molecular weight of the polyesters with a soil detachment capacity may be in the range of from about 250 to about 100,000, or from about 500 to about 50,000 in an alternate embodiment. The acid on which the residue Ph is based may be selected from terephthalic acid, isophthalic acid, phthalic acid, trimellitic acid, mellitic acid, the isomers of sulfophthalic acid, sulfoisophthalic acid and sulfoterephthalic acid and mixtures thereof. Where the acid groups thereof are not part of the ester bond in the polymer, they may be present in salt form, such as an alkali metal or ammonium salt. Exemplary embodiments include sodium and potassium salts.

If desired, instead of the monomer HOOC-Ph-COOH, the polyester with a soil detachment capacity (the anti-redeposition agent) may include small proportions, such as no more than about 10 mole percent relative to the proportion of Ph with the above-stated meaning, of other acids that include at least two carboxyl groups. These include, for example, alkylene and alkenylene dicarboxylic acids such as malonic acid, succinic acid, fumaric acid, maleic acid, glutaric acid, adipic acid, pimelic acid, suberic acid, azelaic acid and sebacic acid. Exemplary diols HO—(CHR$^{11}$—)$_a$OH include those in which R$^{11}$ is hydrogen and "a" is a number of from about 2 to about 6, and in another embodiment includes those in which "a" has the value of 2 and R$^{11}$ is selected from hydrogen and alkyl residues with 1 to 10 C atoms, or where R$^{11}$ is selected from hydrogen and alkyl residues with 1 to 3 C atoms in another embodiment. Examples of diol components are ethylene glycol, 1,2-propylene glycol, 1,3-propylene glycol, 1,4-butanediol, 1,5-pentanediol, 1,6-hexanediol, 1,8-octanediol, 1,2-decanediol, 1,2-dodecanediol and neopentyl glycol. The polymeric diols include polyethylene glycol with an average molar mass in the range from about 1000 to about 6000. If desired, these polyesters may also be end group-terminated, with end groups that may be alkyl groups with 1 to 22 C atoms or esters of monocarboxylic acids. The end groups attached via ester bonds may be based on alkyl, alkenyl and aryl monocarboxylic acids with 5 to 32 C atoms, or with 5 to 18 C atoms in another embodiment. These include valeric acid, caproic acid, enanthic acid, caprylic acid, pelargonic acid, capric acid, undecanoic acid, undecenoic acid, lauric acid, lauroleic acid, tridecanoic acid, myristic acid, myristoleic acid, pentadecanoic acid, palmitic acid, stearic acid, petroselinic acid, petroselaidic acid, oleic acid, linoleic acid, linolaidic acid, linolenic acid, eleostearic acid, arachidic acid, gadoleic acid, arachidonic acid, behenic acid, erucic acid, brassidic acid, clupanodonic acid, lignoceric acid, cerotic acid, melissic acid, benzoic acid, which may bear 1 to 5 substituents having a total of up to 25 C atoms, or 1 to 12 C atoms in another embodiment, for example tert-butylbenzoic acid. The end groups may also be based on hydroxymonocarboxylic acids with 5 to 22 C atoms, which for example include hydroxyvaleric acid, hydroxycaproic acid, ricinoleic acid, the hydrogenation product thereof, hydroxystearic acid, and ortho-, meta- and para-hydroxybenzoic acid. The hydroxymonocarboxylic acids may in turn be joined to one another via their hydroxyl group and their carboxyl group and thus be repeatedly present in an end group. The number of hydroxymonocarboxylic acid units per end group, i.e. their degree of oligomerization, may be in the range of from 1 to 50, or in the range of from 1 to 10 in another embodiment. In an exemplary embodiment, polymers of ethylene terephthalate and polyethylene oxide terephthalate, in which the polyethylene glycol units have molar weights of from about 750 to about 5000 and the molar ratio of ethylene terephthalate to polyethylene oxide terephthalate of from about 50:50 to about 90:10, are used alone or in combination with cellulose derivatives. The anti-redeposition agent is present in the wash composition at an amount of from about 0 to about 3 weight percent, or an amount of from about 0 to about 2 weight percent, or an amount of from about 0 to about 1 weight percent, based on the total weight of the wash composition, in various embodiments.

Neutralizers are optionally added to and included in the wash composition. Exemplary neutralizers include, but are not limited to, sodium hydroxide, triethanol amine, monoethanol amine, buffers, or other compounds that adjusts the pH of the wash composition. Neutralizers may be present in the wash composition at an amount of from about 0 to about 5 weight percent in some embodiments, based on the total weight of the wash composition, but in other embodiments the neutralizer may be present in the wash composition at an amount of from about 0 to about 3 weight percent, or an amount of from about 0 to about 2 weight percent, based on the total weight of the wash composition.

Optical brighteners may optionally be included in the wash composition. Optical brighteners adsorb ultraviolet and/or violet light and re-transmit it as visible light, typically a visible blue light. Optical brighteners include, but are not limited to, derivatives of diaminostilbene disulfonic acid or the alkali metal salts thereof. Suitable compounds are, for example, salts of 4,4'-bis(2-anilino-4-morpholino-1,3,5-triazinyl-6-amino)stilbene 2,2'-disulfonic acid or compounds of similar structure which, instead of the morpholino group, bear a diethanolamino group, a methylamino group, an anilino group or a 2-methoxyethylamino group. Optical brighteners of the substituted diphenylstyryl type may furthermore be present, such as the alkali metal salts of 4,4'-bis(2-sulfostyryl)diphenyl, 4,4'-bis(4-chloro-3-sulfostyryl)diphenyl, or 4-(4-chlorostyryl)-4'-(2-sulfostyryl)diphenyl. Mixtures of the above-stated optical brighteners may also be used. Optical brighteners may be present in the wash composition at an amount of from about 0 to about 1 weight percent in some embodiments, but in other embodiments optical brighteners are present in an amount of from about 0.01 to about 0.5 weight percent, or an amount of from about 0.05 to about 0.3 weight percent, or an amount of from 0.005 to about 5 weight percent, based on the total weight of the wash composition.

Foam inhibitors may also optionally be included in the wash composition. Suitable foam inhibitors include, but are not limited to, soaps of natural or synthetic origin, which include an elevated proportion of $C_{18}$-$C_{24}$ fatty acids. Suitable non-surfactant foam inhibitors are, for example, organopolysiloxanes and mixtures thereof with microfine, optionally silanized silica as well as paraffins, waxes, microcrystalline waxes and mixtures thereof with silanized silica or bis-fatty acid alkylenediamides. Mixtures of different foam inhibitors may also be used, for example mixtures of silicones, paraffins or waxes. In an exemplary embodiment, mixtures of paraffins and bistearylethylenediamide may be used. The wash composition may include the foam inhibitor at an amount of from about 0 to about 5 weight percent, but in other embodiments the foam inhibitor may be present at an amount of from about 0.05 to about 3 weight percent, or an amount of from about 0.5 to about 2 weight percent, based on the total weight of the wash composition.

Chelators bind and remove calcium, magnesium, or other metals from water, and may optionally be included in the wash composition. Many compounds can be used as water softeners, including but not limited to ethylenediaminetetraacetic acid (EDTA), nitrilotriacetic acid, diethylenetriaminepenta(methylenephosphonic acid), nitrilotris(methylenephosphonic acid), 1-hydroxyethane-1,1-diphosphonic acid, iminodisuccinic acid (IDS), or other chelating agents. Chelators may be present in the wash composition at an amount of from about 0 to about 5 weight percent in an exemplary embodiment, but in alternate embodiments the chelators are present at an amount of from about 0.01 to about 3 weight percent or an amount of from about 0.02 to about 1 weight percent, based on the total weight of the wash composition.

Bittering agents may optionally be added to hinder accidental ingestion of the single dose pack or the wash composition. Bittering agents are compositions that taste bad, so children or others are discouraged from accidental ingestion. Exemplary buttering agents include denatonium benzoate, aloin, and others. Bittering agents may be present in the wash composition at an amount of from about 0 to about 1 weight percent, or an amount of from about 0 to about 0.5 weight percent, or an amount of from about 0 to about 0.1 weight percent in various embodiments, based on the total weight of the wash composition.

The components of the wash composition are combined and mixed together with a mixer. The use of the PEG blends as described herein reduces the overall energy required to store the PEG prior to mixing, and reduces the overall time required to complete the mixing process. Once mixed, the wash composition is encapsulated in the container, as described above. The components of the wash composition may all be mixed at one time, or different components may be pre-mixed and then combined. A wide variety of mixers may be used in alternate embodiments, such as an agitator, an in-line mixer, a ribbon blender, an emulsifier, and others. The wash composition is placed in a container, and then the film of the container is sealed with a sealer, where the sealer may utilize heat, water, ultrasonic techniques, water and heat, pressure, or other techniques for sealing the container and forming the single dose pack.

Another exemplary embodiment is also directed to the use of a single dose pack as described above in a cleaning process such as laundry and/or hard surface cleaning. In particular, an embodiment is directed to the use of a single dose pack in laundering of textile and fabrics, such as house hold laundry washing and industrial laundry washing. A further exemplary embodiment is directed to the use of a single dose pack in hard surface cleaning such as automated Dish Washing (ADW), car washing, and the cleaning of industrial surfaces.

The fabrics and/or garments subjected to a washing, cleaning or textile care processes contemplated herein may be conventional washable laundry, such as household laundry. In some embodiments, the major part of the laundry is garments and fabrics, including but not limited to knits, woven fabrics, denims, non-woven fabrics, felts, yarns, and toweling. The fabrics may be cellulose based such as natural cellulosics, including cotton, flax, linen, jute, ramie, sisal or coir or manmade cellulosics (e.g., originating from wood pulp) including viscose/rayon, ramie, cellulose acetate fibers (tricell), lyocell or blends thereof. The fabrics may also be non-cellulose based such as natural polyamides including wool, camel, cashmere, mohair, rabbit, and silk, or the fabric may be a synthetic polymer such as nylon, aramid, polyester, acrylic, polypropylene and spandex/elastin, or blends of any of the above-mentioned products. Examples of blends are blends of cotton and/or rayon/viscose with one or more companion material such as wool, synthetic fibers (e.g., polyamide fibers, acrylic fibers, polyester fibers, polyvinyl alcohol fibers, polyvinyl chloride fibers, polyurethane fibers, polyurea fibers, aramid fibers), and cellulose-containing fibers (e.g., rayon/viscose, ramie, flax, linen, jute, cellulose acetate fibers, lyocell).

In one embodiment, the fabrics and/or garments are added to a washing machine, and the single dose pack is also added to the washing machine before wash water is added. In an alternate embodiment, the single dose pack may be added to an automatic detergent addition system of a washing machine, where the contents of the single dose pack are added to the wash water with the fabrics and/or garments after the washing process has begun. In yet another embodiment, the single dose pack is manually added to the fabrics and/or garments with the wash water after the washing process has started. The film dissolves and releases the wash composition into the aqueous wash water. The film is dissolved and washes out of the washing machine with the excess wash water, so there is nothing to collect from the fabrics and/or garments after the wash cycle. The fabrics and/or garments are laundered with the wash water and the contents of the single dose pack. The fabrics and/or garments may then be dried and processed as normal.

In an alternate embodiment, the single dose pack is added to a detergent charging system for an automatic dish washing machine. The detergent charging system opens and releases the single dose pack to the wash water and a main compartment of the dish washing machine at a designated point in the wash cycle.

Illustrative Examples

The present disclosure is now illustrated by the following non-limiting examples. It should be noted that various changes and modifications can be applied to the following examples and processes without departing from the scope of this disclosure, which is defined in the appended claims. Therefore, it should be noted that the following examples should be interpreted as illustrative only and not limiting in any sense.

Six different wash compositions were prepared according to the foregoing description, three of which included only a single MW PEG as "control" examples, whereas the other three included a blend of two or more different MW-class PEGs at their relative ratio in accordance with the present disclosure. In particular, PEG 3350 PEG was employed as the relatively higher MW PEG, PEG 600 was employed as the mid-MW PEG, and PEG 200 was employed as the relatively lower MW PEG. The wash composition for all the examples included the PEG or PEG blend in a weight percentage of 27.041%. TABLE 1 sets forth the PEG MW ratios used in each of the six examples, noting that the three blended examples are at the ratio. Accordingly, each ratio can thus be multiplied by 27.041% to determine the percentage of each PEG in the overall wash composition of each example. For instance, in Example 4, PEG 600 is in an amount of 13.521% (=27.041%×0.5) by weight of the wash composition; and PEG 3350 is in an amount of 13.521% (=27.041%×0.5) by weight of the wash composition.

TABLE 1

| | Example 1 PEG 3350 (CONTROL) | Example 2 PEG 600 (CONTROL) | Example 3 PEG 200 (CONTROL) | Example 4 PEG 3350:PEG 600 | Example 5 PEG 3350:PEG200 | Example 6 PEG 3350:PEG 600:PEG 200 |
|---|---|---|---|---|---|---|
| PEG 200 RATIO | 0.00 | 0.00 | 1.00 | 0.00 | 0.10 | 0.07 |
| PEG 600 RATIO | 0.00 | 1.00 | 0.00 | 0.50 | 0.00 | 0.26 |
| PEG 3350 RATIO | 1.00 | 0.00 | 0.00 | 0.50 | 0.90 | 0.67 |

In addition to the PEG or PEG blend in a weight percentage of 27.041%, the wash composition for all the examples also included: a C12-C15 alcohol ethoxylate as a nonionic detergent surfactant present in an amount of 23.074 weight percent; added water present in an amount of 18 weight percent (total water in the wash composition amounted to 25.59 weight percent due to its inclusion in some of the other components set forth below); an optical brightener present in an amount of 0.2 weight percent; a bittering agent present in an amount of 0.05 weight percent; an ionic detergent surfactant present in an amount of 22.36 weight percent, where the ionic detergent surfactant is about 60% active; 50 percent sodium hydroxide in water as a neutralizer, where the sodium hydroxide solution was present in an amount of 0.275 weight percent; triethanol amine as a neutralizer present in an amount of 1.4 weight percent, where water is present in the triethanol amine in an amount of about 15 weight percent based on the total weight of the triethanol amine; coconut fatty acids as a foam inhibitor present in an amount of 4 weight percent; a polymer that increases the efficacy of anionic surfactants present in an amount of 2 weight percent; an enzyme solution present in an amount of 1.6 weight percent (the enzyme solution is approximately 8% active enzyme), where the weight percentages are based on the total weight of the wash composition.

Each of the six wash composition examples was included in a single dose laundry pack as described above, using a water-soluble film. Each pack was tested for spring constant and swelling ratio. The spring constant is a measure of the force required to depress the pack a certain distance, and it is indicative of the ability of the pack to withstand loss of height during storage. Relatively larger spring constants are thus a desirable pack property. The swelling ratio is a measure of how the pack changes in weight over time without any force applied thereto, and it is indicative of the ability of the film to withstand degradation by the water in the wash composition. Relatively lower swelling ratios are thus a desirable pack property. The results of the spring constant and swelling ratio testing are set forth below in TABLE 2.

TABLE 2

| | Example 1 PEG 3350 CONTROL PACK | Example 2 PEG 600 CONTROL PACK | Example 3 PEG 200 CONTROL PACK | Example 4 PEG 3350:PEG 600 BLEND PACK | Example 5 PEG 3350:PEG200 BLEND PACK | Example 6 PEG 3350:PEG 600:PEG 200 BLEND PACK |
|---|---|---|---|---|---|---|
| SPRING CONSTANT (N/mm) | 1.34 | 1.12 | 0.67 | 1.32 | 1.27 | 1.30 |
| SWELLING RATIO (S) | −0.05 | 0.06 | 0.18 | 0.00 | −0.04 | −0.04 |

In TABLE 2, the spring constant is determined by the following method: Three 1"×3" strips of PvOH film are prepared. They are then arranged in a 10 cm diameter petri dish and test liquid (in accordance with one of the six wash compositions) is poured over them until completely submerged. A lid is placed on the dish, and the system is allowed to equilibrate for approximately 24 hours. The strips are then removed from the dish, and excess liquid is wiped off using kim wipes. The strips are then individually loaded onto a Tinius Olsen H5KT tensometer equipped with a 250 N load cell and pneumatic grips positioned 1.5" apart. The strips then undergo three 2 mm stretches, and the force/distance (in N/mm) curve is recorded for each stretch. The slope (in N/mm) is recorded for each stretch. The average slope of all curves generated is the value reported in TABLE 2 for the respective wash composition.

In TABLE 2, the swelling ratio is determined by the following method: Three 1"×3" strips of PvOH film are prepared and each strip weighed individually. They are then arranged in a 10 cm diameter petri dish and test liquid (in accordance with one of the six wash compositions) is poured over them until completely submerged. A lid is placed on the dish, and the system is allowed to equilibrate for approximately 24 hours. The strips are then removed from the dish, and excess liquid is wiped off using kim wipes. The strips are then re-weighed. The swelling ratio reported in TABLE 2 is S=(final weight−initial weight)/initial weight, for each respective wash composition.

Out of the three control examples, PEG 3350 had the highest spring constant and the lowest swelling ratio. This is consistent with the disclosure above, which noted that relatively higher MW PEGs are able to accommodate higher water loading with less film degradation. At a ratio of 50 weight percent PEG 600, the high/mid blend achieved a spring constant and swelling ratio that were nearly as good as PEG 3350 control. Likewise, at a ratio of 10 weight percent PEG 200, the high/low blend achieved a spring constant and swelling ratio that were nearly as good as PEG 3350 control. Still further, at a ratio of 26 weight percent PEG 600 and 7 weight percent PEG 200, the high/mid/low blend also achieved a spring constant and swelling ratio that were nearly as good as PEG 3350 control. This testing thus demonstrates that relatively lower MW PEGs and/or mid-MW PEGs can be blended with relatively higher MW PEGs and included in the wash composition, and will retain the beneficial pack properties of the relatively higher MW PEGs alone. Accordingly, such PEG blends can be used to produce wash compositions at a lower overall energy consumption and in a reduced amount of time, as compared to if a relatively higher MW PEG had been used alone.

While at least one exemplary embodiment has been presented in the foregoing detailed description, it should be appreciated that a vast number of variations exist. It should also be appreciated that the exemplary embodiment or exemplary embodiments are only examples, and are not intended to limit the scope, applicability, or configuration of the subject matter in any way. Rather, the foregoing detailed description will provide those skilled in the art with a convenient road map for implementing an exemplary embodiment, it being understood that various changes may be made in the function and arrangement of elements described in an exemplary embodiment without departing from the scope as set forth in the appended claims and their legal equivalents.

What is claimed is:

1. A single dose pack comprising:

a container, wherein the container comprises a water-soluble film; and a wash composition encapsulated within the container, wherein the wash composition comprises:

a detergent surfactant;

water present in an amount of from 10 to about 40 weight percent, based on the total weight of the wash composition; and a polyethylene glycol (PEG) blend comprising at least one relatively higher molecular weight (MW) PEG having an average MW of about 1500 Daltons or greater in combination with at least one mid-MW PEG having an average MW of between about 400 and about 1500 Daltons;

wherein the at least one mid-MW PEG is present in the PEG blend in an amount of from about 5 to about 70 weight percent, based on the total weight of the PEG blend; and wherein the PEG blend is present in an amount of from about 15 to about 50 weight percent, based on the total weight of the wash composition.

2. The single dose pack of claim 1, wherein the water is present in the wash composition in an amount of from about 12 to about 30 weight percent, based on the total weight of the wash composition.

3. The single dose pack of claim 1, wherein the PEG blend is present in the wash composition in an amount of from about 15 to about 40 weight percent, based on the total weight of the wash composition.

4. The single dose pack of claim 1, wherein the at least one mid-MW PEG is present in the PEG blend in an amount of from about 20 to about 65 weight percent, based on the total weight of the PEG blend.

5. The single dose pack of claim 1, wherein the detergent surfactant comprises an ionic detergent surfactant in an amount from about 5 to about 55 weight percent and/or a non-ionic detergent surfactant in an amount from about 5 to about 50 weight percent, based on the total weight of the wash composition.

6. The single dose pack of claim 1, wherein the wash composition further comprises an enzyme in an amount from about 0.001 to about 1 weight percent, based on the total weight of the wash composition.

7. The single dose pack of claim 1, wherein the single dose pack is configured for use in a laundry washing machine or a dishwashing machine.

8. A single dose pack comprising:

a container, wherein the container comprises a water-soluble film; and a wash composition encapsulated within the container, wherein the wash composition comprises:

a detergent surfactant;

water present in an amount of from about 8 to about 40 weight percent, based on the total weight of the wash composition; and a polyethylene glycol (PEG) blend comprising at least one relatively higher molecular weight (MW) PEG having an average MW of about 1500 Daltons or greater in combination with at least one relatively lower MW PEG having an average MW of about 400 Daltons or less;

wherein the at least one relatively lower MW PEG is present in the PEG blend in an amount of from about 5 to about 30 weight percent, based on the total weight of the PEG blend; and wherein the PEG blend is present in an amount of from about 15 to about 50 weight percent, based on the total weight of the wash composition.

9. The single dose pack of claim 8, wherein the at least one relatively lower MW PEG is present in the PEG blend in an amount of from about 5 to about 25 weight percent, based on the total weight of the PEG blend.

10. The single dose pack of claim 8, wherein the water is present in the wash composition in an amount of from about 10 to about 30 weight percent, based on the total weight of the wash composition.

11. The single dose pack of claim 8, wherein the PEG blend is present in the wash composition in an amount of from about 15 to about 40 weight percent, based on the total weight of the wash composition.

12. The single dose pack of claim 8, wherein the detergent surfactant comprises an ionic detergent surfactant in an amount from about 5 to about 55 weight percent and/or a non-ionic detergent surfactant in an amount from about 5 to about 50 weight percent, based on the total weight of the wash composition.

13. The single dose pack of claim 8, wherein the wash composition further comprises an enzyme in an amount from about 0.001 to about 1 weight percent, based on the total weight of the wash composition.

14. The single dose pack of claim 8, wherein the single dose pack is configured for use in a laundry washing machine or a dishwashing machine.

15. A single dose pack comprising:

a container, wherein the container comprises a water-soluble film; and a wash composition encapsulated within the container, wherein the wash composition comprises:

a detergent surfactant;

water present in an amount of from 10 to about 40 weight percent, based on the total weight of the wash composition; and a polyethylene glycol (PEG) blend comprising at least one relatively higher molecular weight (MW) PEG having an average MW of about 1500 Daltons or greater in combination with at least one relatively lower MW PEG having an average MW of about 400 Daltons or less and at least one mid-MW PEG having an average MW of between about 400 and about 1500 Daltons;

wherein the at least one relatively lower MW PEG is present in the PEG blend in an amount from about 5 to about 20 weight percent and the at least one mid-MW PEG is present in the PEG blend in an amount from about 5 to about 40 weight percent, based on the total weight of the PEG blend; and wherein the PEG blend is present in an amount of from about 15 to about 50 weight percent, based on the total weight of the wash composition.

16. The single dose pack of claim 15, wherein the at least one relatively lower MW PEG is present in the PEG blend in an amount from about 5 to about 15 weight percent and the at least one mid-MW PEG is present in the PEG blend in an amount from about 10 to about 35 weight percent, based on the total weight of the PEG blend.

17. The single dose pack of claim 15, wherein the water is present in the wash composition in an amount of from about 10 to about 30 weight percent, based on the total weight of the wash composition.

18. The single dose pack of claim 15, wherein the detergent surfactant comprises an ionic detergent surfactant in an amount from about 5 to about 55 weight percent and/or a non-ionic detergent surfactant in an amount from about 5 to about 50 weight percent, based on the total weight of the wash composition.

19. The single dose pack of claim 15, wherein the wash composition further comprises an enzyme in an amount from about 0.001 to about 1 weight percent, based on the total weight of the wash composition.

20. The single dose pack of claim 15, wherein the PEG blend is present in the wash composition in an amount of from about 15 to about 40 weight percent, based on the total weight of the wash composition.

* * * * *